United States Patent [19]

Taylor et al.

[11] Patent Number: 4,532,158

[45] Date of Patent: Jul. 30, 1985

[54] APPARATUS FOR AND A METHOD OF METERING OF COATING ON A MOVING WEB

[75] Inventors: John A. Taylor, Suffern; Robert M. Fridhandler, Blauvelt, both of N.Y.

[73] Assignee: St. Regis Paper Company, New York, N.Y.

[21] Appl. No.: 252,302

[22] Filed: Apr. 9, 1981

[51] Int. Cl.[3] ..... B05C 11/04

[52] U.S. Cl. ..... 427/355; 118/106; 118/126

[58] Field of Search ..... 118/126, 123, 413, 106; 427/355, 356, 358

[56] References Cited

U.S. PATENT DOCUMENTS

| | | | |
|---|---|---|---|
| 3,081,191 | 3/1963 | Smith et al. | 118/413 X |
| 3,389,680 | 6/1968 | Moore | 118/413 X |
| 3,722,465 | 3/1973 | Krautzberger | 118/123 |
| 3,882,817 | 5/1975 | Zink | 118/126 |
| 4,327,130 | 4/1982 | Pipkin | 118/126 X |
| 4,331,713 | 5/1982 | Girard et al. | 118/122 X |

FOREIGN PATENT DOCUMENTS

| | | | |
|---|---|---|---|
| 2356737 | 5/1975 | Fed. Rep. of Germany | 427/358 |
| 36801 | 9/1972 | Japan | 427/355 |

*Primary Examiner*—John P. McIntosh

*Attorney, Agent, or Firm*—Joseph M. Maguire

[57] ABSTRACT

A method and apparatus are provided for metering of coating on a moving web of material, such as linerboard, paperboard, paper, film, foil or the like, in which the web is fed between a support and a skirt of flexible plastic sheet material extending across the full width of the web and having a free end portion extending contiguous and parallel to and in the direction of movement of the web, and a pressurized tube in contact with the free end portion of the skirt cooperates with the skirt and the web to create a constant pressure web coating region between the web and the free end portion of the skirt within which the coating thickness is skimmed down to provide a layer of coating on the web of substantially uniform thickness.

4 Claims, 3 Drawing Figures

APPARATUS FOR AND A METHOD OF METERING OF COATING ON A MOVING WEB

BACKGROUND OF THE INVENTION

This invention relates generally to apparatus for and a method of metering of coating, and more particularly to a device for and a method of controlling the thickness of a coating composition on the coated side of a moving web of material, such as linerboard, paperboard, paper, film, foil or the like.

Numerous devices exist for metering excess applied coating color on a moving web into a smooth thin layer. These include blades that are prestressed into the moving web by torsional loading, blades that are loaded by air bags, blades that are mechanically loaded, and blades that are loaded by combinations of such loadings. Such devices have various deficiencies, such as high cost, complex support and adjustment elements, and difficulty in maintaining uniform contact pressure between the blade and the web, resulting in streaks, mottling scratches and variations in coating thickness across the width of the web.

SUMMARY OF THE INVENTION

The general object of the present invention is the provision of a device for and a method of metering of coating on a continuously moving web of material possessing the virtues of compactness, simplicity, reliability, low cost, quick startup, minimal operator involvement, reproducibility of coating weights, and ability to provide a smooth layer of coating of substantially uniform thickness with minimal streaking, mottling or scratching.

In accordance with the invention, a method and apparatus are provided for metering of coating on the coated side of a moving web of material, such as paper, paperboard, linerboard, film, foil or the like, comprising an expansible pressure tube extending across the full width of the web, with provisions for supporting the tube including a channel member containing the tube and proportioned and arranged to inhibit rotation thereof. A skirt of flexible plastic sheet material is secured to the channel member, extends across the full width of the web, and has a free end portion extending contiguous and parallel to and in the direction of movement of the web and intermediate the tube and web. Upon expansion the tube cooperates with the web and the skirt to create a constant pressure web coating region between the web and the free end portion of the skirt within which the coating thickness is skimmed down to provide a smooth layer of coating of substantially uniform thickness essentially free of streaks, mottling and scratches.

DESCRIPTION OF THE PREFERRED EMBODIMENT

Figure 1:
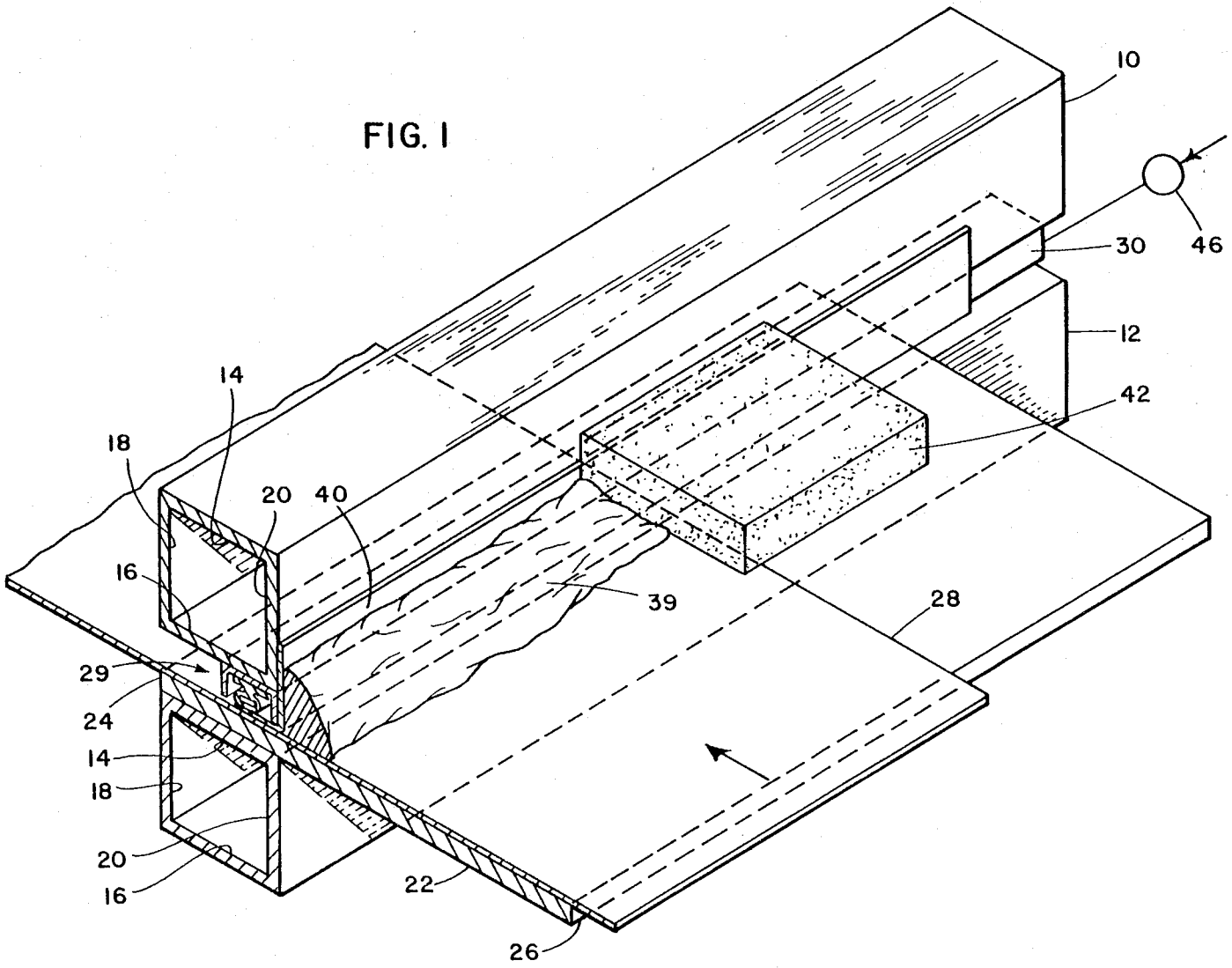
FIG. 1 is a fragmentary perspective view of a coating metering device constructed in accordance with the invention.

The apparatus shown in FIG. 1 comprises horizontally arranged vertically spaced and aligned upper 10 and lower 12 hollow metallic box beams of rectangular cross section each formed by top 14, bottom 16, and side 18 and 20 walls. A horizontal rectangular skid plate 22 is secured by screws to wall 14 of beam 12, extends between the opposite ends of beam 12, and has one edge 24 in alignment with wall 18 of beam 12 and its opposite edge 26 extending beyond the wall 20 of beam 12. Plate 22 is preferably made of high density polyethylene to provide a suitable surface for the continuous movement thereover, in the direction of the arrow, of a web 28 of linerboard material. Beam 10 provides support for a coating metering device 29 including a channel member 30 formed by a web 32 and legs 34 and 36 and containing an expansible oval shaped pressure tube 38, with a protective skirt 40 extending between tube 38 and web 28 and secured to channel member 30. Sponge dams 42 at opposite side edges of web 28 are supported by plate 22, with each sponge having a side edge slightly overlapping web 28 and a trailing edge in contact with skirt 40 to contain a puddle of water-based coating 39 on the linerboard. The coating material may be supplied from any suitable chamber or applicator located upstream of skirt 40 at a rate within the capacity of the sponge dams 42 to contain excess coating composition removed by the metering device of the invention.

Channel member 30 extends between and along most of the length of beams 10 and 12, has the exterior side of its web 32 secured to wall 16 of beam 10, and has its legs 34 and 36 extending vertically downward from web 32 to a position contiguous to the linerboard, with leg 36 having its exterior surface in vertical alignment with the exterior surface of wall 20 of beam 10. Tube 38 is formed of rubber or a similar elastomeric material and has a flange 44 secured by adhesive transfer tape to the interior side of web 32. Tube 38 extends along most of the length of channel member 30 and over the entire width of web 28, and has one end closed and its opposite end connected for supply of air through a regulator 46 set to limit air pressure to a maximum of 40 psi (2.81 kg per sq. cm) to prevent tube 38 from rupturing. Channel member 30 and tube 38 are so proportioned and arranged as to inhibit rotation of tube 38 when it is inflated.

In accordance with the invention, skirt 40 is secured by tape to wall 20 of beam 10 and by adhesive to the exterior of leg 36 of channel member 30 and has a horizontal free end portion **40*a* extending across the entire width of web 28 and cooperating with tube 38 and web 28 to meter the coating on web 28. Free end portion 40*a* extends contiguous and parallel to and in the direction of movement of web 28 and intermediate tube 38 and web 28. Upon expansion, tube 38 cooperates with web 28 and free end portion 40*a* of the skirt to create a constant pressure region between the web 28 and free end portion 40*a*. Preferably, free end portion 40*a* of skirt 40 should have its upper face coated with an adhesive so that it will adhere to the bottom surface of tube 38. Also, the transverse or trailing edge 40*b* of free end portion 40*a* should be completely beneath tube 38 when it is expanded to hold down free end portion 40*a* and to prevent tube 38 from contacting, and thereby becoming abraded by, web 28. Edge 40*b* should not extend beyond the contact area of tube 38** because in operation the free flapping edge would cause wet streaks in the linerboard coating.

By way of example, and not of limitation, in the device of FIG. 1 each of the beams 10 and 12 is 4" (10.16 cm) by 4" (10.16 cm) by ¼" (0.64 cm) and 77" (195.58 cm) long. Skid plate 22 is made of high density polyethylene and is 12" (30.48 cm) wide by ¼" (0.64 cm) thick and long enough to accommodate the web passed over it. Tube 38 is made of neoprene rubber and has a ⅝" (1.59 cm) wide base, 7/16" (1.11 cm) unexpanded height, 11/16" (1.75 cm) maximum expanded height, and a length 4" (10.16 cm) greater than the width of web 28. Channel member 30 is 1" (2.54 cm) by ½" (1.27 cm) by ⅛" (0.32 cm) and of a length suitable to accommodate tube 38. Skirt 40 is made of ultra high molecular weight polyethylene 0.010" (0.254 cm) to 0.015" (0.381 mm) in caliper and 2" (5.08 cm) wide with adhesive backing on the surface facing tube 38.

In operation, tube 38 is inflated to a pressure of about 10 psi (0.703 kg per sq. cm). The web 28, carrying a water-based coating material on its upper surface, is passed between skid plate 22 and the free end portion 40*a* of skirt 40. Upon expansion, tube 38 cooperates with web 28 and the free end portion 40*a* of skirt 40 to create a constant pressure web coating region between the web and the free end portion of the skirt within which the coating thickness is skimmed down to provide a smooth layer of coating of substantially uniform thickness substantially devoid of wet streaks, mottling, and scratches.

Figure 2:
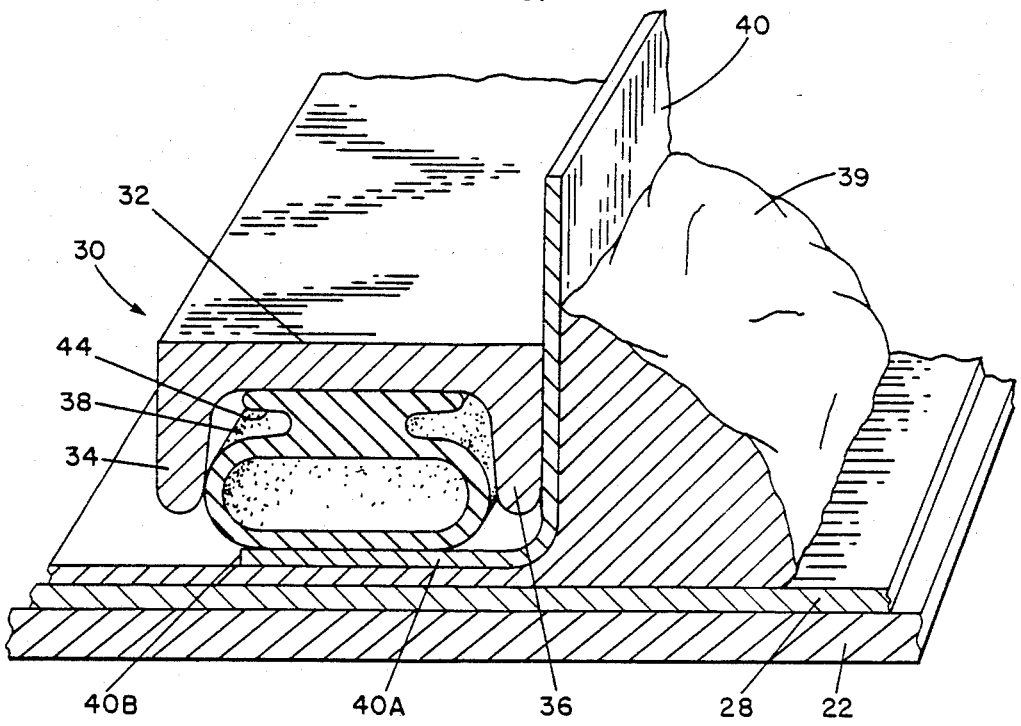
FIG. 2 is an enlarged fragmentary perspective view of the air bag-skirt assembly of FIG. 1.
Figure 3:
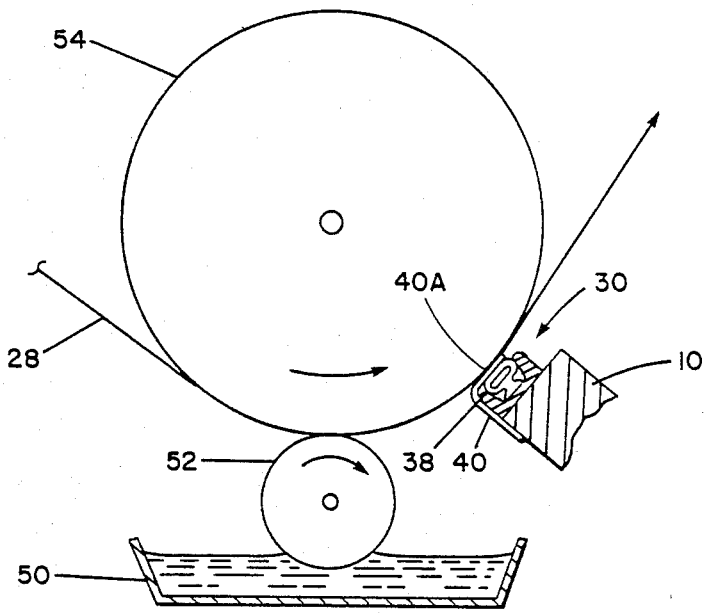
FIG. 3 is a schematic end view of another embodiment of the invention.

In the embodiment of FIG. 3 the coating apparatus comprises a trough or pan 50 containing coating composition and in which an applicator roll 52 is immersed. A backup roll 54 is arranged in opposition to roll 52 and a paper web 28 enters the nip between rolls 52 and 54. The coating composition taken up from pan 50 by roll 52 is applied to web 28 with excess coating dropping from the web to the pan as the web is conveyed to a coating metering device of generally the same construction and arrangement as that of FIGS. 1 and 2. This device includes a channel member 30 extending across the full width of web 28 and having its web secured to a backup beam 10, an expansible pressure tube 38 disposed within and extending along the length of and secured to channel member 30, and a skirt 40 to channel member 30 and beam 10 and having a free end portion 40*a* extending contiguous and parallel to and in the direction of movement of web 28 and intermediate tube 38 and web 28. As the web 28 passes through the constant pressure region intermediate web 28 and the free end portion 40*a* of skirt 40, the coating thickness is skimmed down to the desired uniform coating thickness and excess coating composition removed by the metering device drops back into pan 50.

We claim:

1. Apparatus for metering of coating on the coated side of a moving web of material comprising an expansible pressure tube extending across the full width of the coated side of the web, a backing surface adapted to support the other side of the web, a skirt of papery, flexible plastic sheet material extending across the full width of the coated side of the web and having a free end portion extending contigous and parallel to and in the direction of movement of the web and intermediate the tube and web, and means for supporting the tube and skirt, the tube upon expansion having a part of its surface in contact with said portion of the skirt and cooperating with the web and said portion of the skirt and the backing surface to create a constant pressure web coating region throughout the space between the web and said portion of the skirt within which the coating thickness is skimmed down to provide a layer of coating on the web of substantially uniform thickness, the free end portion of the skirt being positioned to prevent the surface of the tube from contacting the web and having its trailing edge, relative to the direction of movement of the web, in contact with the tube to prevent flapping of the edge.

2. Apparatus for metering of coating as recited in claim 1, in which the means for supporting the tube and skirt includes a channel member containing and secured to the tube, proportioned and arranged to prevent rotation of the tube, and having its outer surface attached to the skirt.

3. A method for metering of coating on the coated side of a moving web of material comprising feeding the web between a backing surface adapted to support the other side of the web and a skirt of papery, plastic sheet material extending across the full width of the web and having a free end portion extending contiguous and parallel to and in the direction of movement of the web, and utilizing an expansible pressure tube extending across the full width of the web in contact with the free end portion of the skirt to create a constant pressure web coating region across the web throughout the space between the coated side of the web and said portion of the skirt within which the coating thickness is skimmed down to provide a coating on the web of substantially uniform thickness, the free end portion of the skirt having its trailing edge, relative to the direction of movement of the web, in contact with the tube to prevent flapping of the edge.

4. Apparatus for metering of coating on the coated side of a moving web of material comprising an expansible pressure tube extending across the full width of the coated side of the web; a skirt of papery, flexible plastic sheet material extending across the full width of the coated side of the web and having a portion extending contiguous and parallel to and in the direction of movement of the web and intermediate the tube and web; means for supporting the tube and skirt including a channel member containing and secured to the tube, proportioned and arranged to prevent rotation of the tube, and having its outer surface attached to the skirt; horizontally arranged vertically spaced and aligned upper and lower beams of rectangular cross section; and a horizontally arranged rectangular skid plate disposed intermediate the lower beam and the web and secured to the upper surface of the lower beam and providing a surface for the continuous movement of the web thereover; the channel member having the exterior side of its web secured to the bottom surface of the upper beam, the exterior side of one of its legs in vertical alignment with the exterior surface of one of the sides of the upper beam, and its legs extending vertically downward to a position contiguous to the moving web; the tube upon expansion having a part of its surface in contact with said portion of the skirt and cooperating with the web and said portion of the skirt and the skid plate to create a constant pressure web coating region throughout the space between the web and said portion of the skirt within which the coating thickness is skimmed down to provide a layer of coating on the web of substantially uniform thickness.

* * * * *